US006341774B1

(12) United States Patent
Ueda

(10) Patent No.: US 6,341,774 B1
(45) Date of Patent: Jan. 29, 2002

(54) SHEET FEEDING DEVICE HAVING GAP REGULATING MEMBER TO AVOID DOUBLE FEEDING OF SHEETS AND IMAGE FORMING APPARATUS USING FEEDING DEVICE

(75) Inventor: Kenji Ueda, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/617,284

(22) Filed: Jul. 17, 2000

(30) Foreign Application Priority Data

Jul. 16, 1999 (JP) ..... 11-202550

(51) Int. Cl.[7] ..... B65H 3/06
(52) U.S. Cl. ..... 271/119
(58) Field of Search ..... 271/119, 120, 271/124, 138

(56) References Cited

U.S. PATENT DOCUMENTS 5,372,359 A * 12/1994 Miura et al. ..... 271/119
5,934,664 A * 8/1999 Murayama et al. ..... 271/118 X
6,082,726 A * 7/2000 Inoue et al. ..... 271/4.08 X

FOREIGN PATENT DOCUMENTS

JP 07304527 A 11/1995
JP 08040577 A 2/1996
JP 10181913 A 7/1998

* cited by examiner

*Primary Examiner*—Christopher P. Ellis
*Assistant Examiner*—Kenneth W Bower
(74) *Attorney, Agent, or Firm*—Oblon, Spivak, McClelland, Maier & Neustadt, P.C.

(57) ABSTRACT

A sheet feeding device includes a sheet feeding cassette configured to accommodate a stack of sheets, a sheet feeding roller that is provided downstream of the sheet feeding cassette in a sheet conveying direction to feed a top sheet of the stack of sheets in the sheet feeding cassette, the sheet feeding roller having a cross-sectional shape of a partly cut-off circle including an arc portion and at least one chord portion, a friction pad that is provided opposite the sheet feeding roller to separate the top sheet from the rest of the stack of sheets in the sheet feeding cassette, and a regulating member that is provided to the sheet feeding roller so as to face the friction pad and to regulate a gap between the chord portion of the sheet feeding roller and an upper surface of the friction pad. When the sheet feeding roller is in a standby condition, the sheet feeding roller is held such that the chord portion of the sheet feeding roller faces the friction pad and the stack of sheets in the sheet feeding cassette is a predetermined distance apart therefrom, the friction pad is held at a more elevated position than when the friction pad abuts the arc portion of the sheet feeding roller, and a periphery of the regulating member is closer to the upper surface of the friction pad than the chord portion of the sheet feeding roller.

12 Claims, 9 Drawing Sheets

SHEET FEEDING DEVICE HAVING GAP REGULATING MEMBER TO AVOID DOUBLE FEEDING OF SHEETS AND IMAGE FORMING APPARATUS USING FEEDING DEVICE

CROSS-REFERENCE TO RELATED APPLICATIONS

This application claims priority under 35 USC 119 and contains subject matter related to Japanese Patent Application No. 11-202550 filed in the Japanese Patent Office on Jul. 16, 1999, the entire contents of which are hereby incorporated by reference herein.

BACKGROUND OF THE INVENTION

1. Field of the Invention

The present invention relates to a sheet feeding device for use in an image forming apparatus such as a copying machine, a facsimile, a laser printer, or similar image forming apparatus.

2. Discussion of the Background

FIG. 5 is a schematic cross-sectional view illustrating a conventional sheet feeding device of an image forming apparatus, such as a laser printer. FIG. 6 is a cross-sectional view illustrating a part in the vicinity of a sheet feeding roller of the conventional sheet feeding device of FIG. 5. The image forming apparatus in FIG. 5 includes a sheet feeding roller 1, a sheet feeding cassette 2, a cassette bottom plate 3, a pair of sheet conveying rollers 4, sheets 5, an image forming section 6, a fixing section 7, a sheet discharging section 8, and a sheet discharging tray 9. The sheet feeding cassette 2 is configured so that it can be removed from the image forming apparatus by being drawn out to the right-hand side as seen in FIG. 5.

As illustrated in FIG. 6, the sheet feeding device includes a friction pad 10 at a lower portion of the sheet feeding roller 1 to separate a top sheet from the rest of the stack of sheets 5 in the sheet feeding cassette 2. The sheets 5 in the sheet feeding cassette 2 are fed through the conventional sheet feeding device via a friction pad sheet separating method. The friction pad 10 is attached to a friction pad pedestal 11 that is biased by a spring 12 to protrude upwardly. However, the friction pad pedestal 11 is prevented from protruding too far past a predetermined extent by a hook pawl 11*a* which is provided at a lower end portion of the friction pad pedestal 11 and is caught by a part of a holding section 2*a* of the sheet feeding cassette 2.

Operations of the sheet feeding device will now be described. First, the sheet feeding roller 1 rotates when a clutch (not shown) is turned on by a driving device (not shown), and thereby starts to feed the sheets 5. Then, a top sheet is separated from the rest of the sheets 5 in the sheet feeding cassette 2 by the friction pad 10 which is pressed by the sheet feeding roller 1. The top sheet is then conveyed to the sheet conveying rollers 4 which are disposed downstream of the sheet feeding roller 1 in the sheet conveying direction. After the leading edge of the top sheet reaches a nip portion between the sheet conveying rollers 4, the driving of the sheet feeding roller 1 is stopped when the clutch is turned off by the driving device. Subsequently, the sheet feeding roller 1 is rotated together with the top sheet conveyed by the sheet conveying rollers 4. When the trailing edge of the top sheet passes through a nip portion between the sheet feeding roller 1 and the friction pad 10, the rotation of the sheet feeding roller 1 is stopped.

In the above-described operations of the sheet feeding device, a load or force F is received by the top sheet of the sheets 5 when the top sheet of the sheets 5 is pulled out from the sheet feeding cassette 2 by the sheet conveying rollers 4 under the condition that the sheet feeding roller 1 is not driven. The load F is a sum of a load Fp and a load Ff and a load Fk. The load Fp is received by the top sheet of the sheets 5 when the cassette bottom plate 3 presses the top sheet of the sheets 5 against the sheet feeding roller 1. The load Ff is received by the top sheet of the sheets 5 when the top sheet of the sheets 5 is pressed against at the nip between the sheet feeding roller 1 and the friction pad 10. The load Fk is a sum of a load received by the top sheet of the sheets 5 when the top sheet of the sheets 5 is bent along a curved sheet conveying path, another load received by the top sheet of the sheets 5 when the sheet feeding roller 1 is rotated together with the top sheet of the sheets 5 conveyed by the sheet conveying rollers 4, and other loads.

In the above-described sheet feeding device, the load Fp is in a range of about 150 gf to 250 gf, the load Ff is in a range of about 250 gf to 400 gf, and the load Fk is in a range of about 50 gf~150 gf. Therefore, the load F is in a range of about 450 gf~800 gf. Because the sheet conveying rollers 4 pull out the top sheet of the sheets 5 from the sheet feeding cassette 2 against the above-described load, the following problems typically occur. First, the sheet conveying rollers 4 are likely to be worn due to heavy load. Second, if rubber of superior wear resistance is used for the sheet conveying rollers 4 so as to improve the wear resistance of the sheet conveying rollers 4, an increase in cost will result. Third, in order to convey the top sheet of the sheets 5 with a stable speed, it may be necessary to increase the sheet conveying force of the sheet conveying rollers 4. However, for this reason, a roller holding section for the sheet conveying rollers 4 may need to be of sturdy construction, and the load of the motor may increase. Thus, both an increased cost and size of the image forming apparatus may result.

In order to reduce the above-described load received by a sheet when the sheet is conveyed by the sheet conveying rollers 4, a conventional sheet feeding roller, having a cross-sectional shape which is approximately a partly cut-off circle (e.g., a semicircle), is known. As illustrated in FIGS. 7A through 7D, a sheet feeding roller 20 has a cross-sectional shape of a partly cut-off circle including an arc portion 22 and a chord portion 21. It is configured so that after one rotation of the sheet feeding roller 20, the sheet feeding roller 20 does not contact the friction pad 10 and the stack of sheets 5 in the sheet feeding cassette 2.

As illustrated in FIG. 7A, when the sheet feeding roller 20 is in a standby condition, the sheet feeding roller 20 is held such that the chord portion 21 of the sheet feeding roller 20 faces both the friction pad 10 and the stack of sheets 5 in the sheet feeding cassette 2. In this standby condition, the hook pawl 11*a*, which is provided at a lower end portion of the friction pad pedestal 11, is caught by the portion of the holding section 2*a* provided at the rear end of the sheet feeding cassette 2, so that the friction pad 10 is not elevated to a higher position. Thereby, a gap is formed between the upper surface of the friction pad 10 and the chord portion 21 of the sheet feeding roller 20. Moreover, when the sheet feeding roller 20 is in the standby condition, the cassette bottom plate 3 is locked by a locking mechanism (not shown), so that the sheets 5 in the sheet feeding cassette 2 are not elevated to a higher position. Thereby, the gap formed between the surface of the sheets 5 and the chord portion 21 of the sheet feeding roller 20 remains the same.

In the sheet feeding device including the sheet feeding roller 20 having a cross-sectional shape of a partly cut-off circle, when the feeding of the top sheet of the sheets 5 is begun, the sheet feeding roller 20 starts its one full rotation under the action of a one-rotation clutch (not shown). When the sheet feeding roller 20 starts to rotate, the cassette bottom plate 3 is unlocked by releasing the locking mechanism immediately before the arc portion 22 of the sheet feeding roller 20 contacts the top sheet of the sheets 5. Subsequently, the arc portion 22 contacts the top sheet of the sheets 5 in the sheet feeding cassette 2, and a few sheets of the sheets 5 start to be fed by the sheet feeding roller 20 as the sheets 5 are pressed against the sheet feeding roller 20 by a biasing force of a spring 23 serving as a bottom plate pressing mechanism. When the arc portion 22 of the sheet feeding roller 20 rotates to a position so as to contact the friction pad 10, the friction pad 10 is pressed against by the arc portion 22 and depressed to a predetermined position so as to be in pressing contact with the arc portion 22. Then, the top sheet is separated from the rest of the sheets 5 fed from the sheet feeding cassette 2 by the friction pad 10 and is conveyed downstream of the sheet feeding roller 20 as illustrated in FIG. 7B.

Subsequently, before the chord portion 21 of the sheet feeding roller 20 faces the sheets 5 in the sheet feeding cassette 2, the cassette bottom plate 3 is locked at a current position by the locking mechanism. Because, if the cassette bottom plate 3 is not locked before the chord portion 21 faces the sheets 5, the upper surfaces of the sheets 5 move up so as to contact the chord portion 21 and thus, no gap is formed between the upper surfaces of the sheets 5 and the sheet feeding roller 20.

As illustrated in FIG. 7C, the sheet feeding roller 20 further rotates and is held at a standby position wherein the chord portion 21 faces the sheets 5 and the friction pad 10. FIG. 7D illustrates the sheet feeding device in the condition that the height of the stack of sheets 5 in the sheet feeding cassette 2 is shorter than the height of the stack of sheets 5 in FIG. 7C. In FIG. 7D, the upper surfaces of the sheets 5 are held at a predetermined position when the upper surfaces of the sheets 5 contact the arc portion 22 of the sheet feeding roller 20. By locking the cassette bottom plate 3 with the locking mechanism while the sheets 5 contact the arc portion 22, the positions of the upper surfaces of the sheets 5, when the sheet feeding roller 20 is in the standby condition, can be kept constant regardless of the number of sheets 5 (or the height of the stack of sheets 5) in the sheet feeding cassette 2.

Referring to FIGS. 8A and 8B, the gap between the chord portion 21 of the sheet feeding roller 20 and the upper surface of the friction pad 10 will be described, when the sheet feeding roller 20 is in the standby condition. Although the sheet feeding roller 20, illustrated in FIGS. 8A and 8B, has a different shape than the sheet feeding roller 20, illustrated in FIGS. 7A through 7D, the operation and function of the sheet feeding roller 20 is substantially the same. Therefore, the structural elements of the sheet feeding roller 20 in FIGS. 8A and 8B having substantially the same functions as the structural elements in FIGS. 7A through 7D are designated with the same reference characters. In addition, although the shape of the holding section 2*a*, provided adjacent the sheet feeding cassette 2 for catching the hook pawl 11*a* at the lower end portion of the friction pad pedestal 11, is different from the holding section 2*a* in FIGS. 7A through 7D, there is no significant difference in operation and function.

FIG. 9 is a perspective view of the sheet feeding roller 20 illustrated in FIGS. 8A and 8B. The sheet feeding roller 20 is an integrally formed by molding such material as synthetic resin, plastic, etc. As illustrated in FIG. 9, the sheet feeding roller 20 is constructed of a partly cut-off cylindrical portion and two flange portions 30. The two flange portions are integrally formed with the above-described cylindrical portion at each end thereof. The cylindrical portion has the cross-sectional shape of a partly cut-off circle, including an arc portion and two chord portions. Each flange portion 30 also has the cross-sectional shape of a partly cut-off circle, including an arc portion and two chord portions. A belt-shaped member with a high coefficient of friction, such as the coefficient of friction of rubber, is put around the cylindrical portion and the belt-shaped member closely contacts the cylindrical portion.

Referring to FIGS. 8A and 8B, the sheet feeding roller 20 includes the arc portion 22 and chord portions 21*a* and 21*b*. The arc portion 22 contacts and feeds the sheets 5. The arc portion 22 is illustrated in FIGS. 8A and 8B by diagonal shading. The arc portion 22 corresponds to the arc portion of the cylinder portion and includes the surrounding belt-shaped member having the high coefficient of friction. The chord portions 21*a* and 21*b* correspond to the chord portions of the flange portion 30, illustrated in FIG. 9, and neither chord portion 21*a* nor chord portion 21*b* contact the sheets 5.

FIG. 8A illustrates a sheet feeding device when the sheet feeding roller 20 feeds the top sheet of the sheets 5, corresponding to the sheet feeding device illustrated in FIG. 7B. When the sheet feeding roller 20 feeds the top sheet of the sheets 5, the friction pad 10 is situated at a lower position than when the sheet feeding roller 20 is in the standby condition. The friction pad 10 is lower by a distance S1 because the arc portion 22 of the sheet feeding roller 20 contacts and presses the friction pad 10. When the sheet feeding roller 20 stops rotating and returns to the standby condition as illustrated in FIG. 8B, the friction pad 10 is situated at a more elevated position (i.e., by a distance S1) than when the sheet feeding roller 20 feeds the sheets 5. In this condition, as illustrated in FIG. 8B, a gap S2 is formed between the chord portion 21*b* and the upper surface of the friction pad 10. In the above-described sheet feeding device, the gap S2 is large enough to cause a plurality of sheets 5 to enter the gap S2. Consequently, a double feeding of the sheets (i.e., a plurality of sheets being fed at one time) is likely to occur when the top sheet is conveyed by the sheet conveying rollers 4. Specifically, when the coefficient of friction between the sheets 5 is large and when the sheets 5 have a property of attracting each other due to static electricity (e.g., a tracing paper), the sheets 5 under the top sheet are likely to be conveyed together with the top sheet when the top sheet is conveyed by the sheet conveying rollers 4.

A sheet separating method employing corner claws in a sheet feeding cassette is known to be effective in reducing the load received by a sheet when the sheet is pulled out from the sheet feeding cassette. Compared to a sheet separating method employing a friction pad, the sheet separating method employing corner claws generally has drawbacks. For example, double feeding of sheets is likely to occur, and the margin of the thickness of a sheet to be fed is limited to a smaller value (e.g., neither thick sheet nor thin sheet is suitable to be fed).

SUMMARY OF THE INVENTION

The present invention has been made in view of the above-discussed and other problems, and an object of the present invention is to address these problems.

The preferred embodiments of the present invention provide a novel sheet feeding device and image forming apparatus, wherein a load received by a sheet can be reduced and double feeding of sheets can be prevented.

In order to achieve the above-described and other objectives, the present invention provides a novel sheet feeding device, including a sheet feeding cassette configured to accommodate a stack of sheets, and a sheet feeding roller that is provided downstream of the sheet feeding cassette in a sheet conveying direction to feed a top sheet of the stack of sheets in the sheet feeding cassette. A sheet feeding roller having a cross-sectional shape of a partly cut-off circle includes an arc portion and at least one chord portion. The sheet feeding device further includes a friction pad that is provided opposite the sheet feeding roller to separate the top sheet from the rest of the sheets in the stack in the sheet feeding cassette. A regulating member is provided on the sheet feeding roller so as to face the friction pad and to regulate a gap between the chord portion of the sheet feeding roller and an upper surface of the friction pad. When the sheet feeding roller is in a standby condition, the sheet feeding roller is held such that the chord portion of the sheet feeding roller faces the friction pad and the stack of sheets in the sheet feeding cassette at a predetermined distance apart therefrom. The friction pad is held at a more elevated position than when the friction pad abuts the arc portion of the sheet feeding roller, and a periphery of the regulating member is closer to the upper surface of the friction pad than the chord portion of the sheet feeding roller.

According to the present invention, the top sheet may slidably contact the regulating member when the top sheet is conveyed. The regulating member may include resin. The regulating member may rotate in a same direction as the sheet feeding roller.

According to another preferred embodiment of the present invention, a sheet feeding device includes a sheet feeding cassette configured to accommodate a stack of sheets, and a friction pad configured to separate a top sheet from the rest of the stack of sheets in the sheet feeding cassette. The sheet feeding device further includes a sheet feeding roller that is provided downstream of the sheet feeding cassette in a sheet conveying direction and opposite the friction pad to feed the top sheet of the stack of sheets in the sheet feeding cassette. The sheet feeding roller has a cross-sectional shape of a partly cut-off circle, including an arc portion and at least one chord portion. The chord portion includes a regulating portion that is formed as an integral part of the chord portion of the sheet feeding roller so as to face the friction pad and to regulate a gap between the chord portion and an upper surface of the friction pad when the sheet feeding roller is in a standby condition. When the sheet feeding roller is in the standby condition, the sheet feeding roller is held such that the chord portion of the sheet feeding roller faces the friction pad and the stack of sheets in the sheet feeding cassette a predetermined distance apart therefrom. The friction pad is held at a more elevated position than when the friction pad abuts the arc portion of the sheet feeding roller, and a periphery of the regulating portion is closer to the upper surface of the friction pad than the chord portion of the sheet feeding roller.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
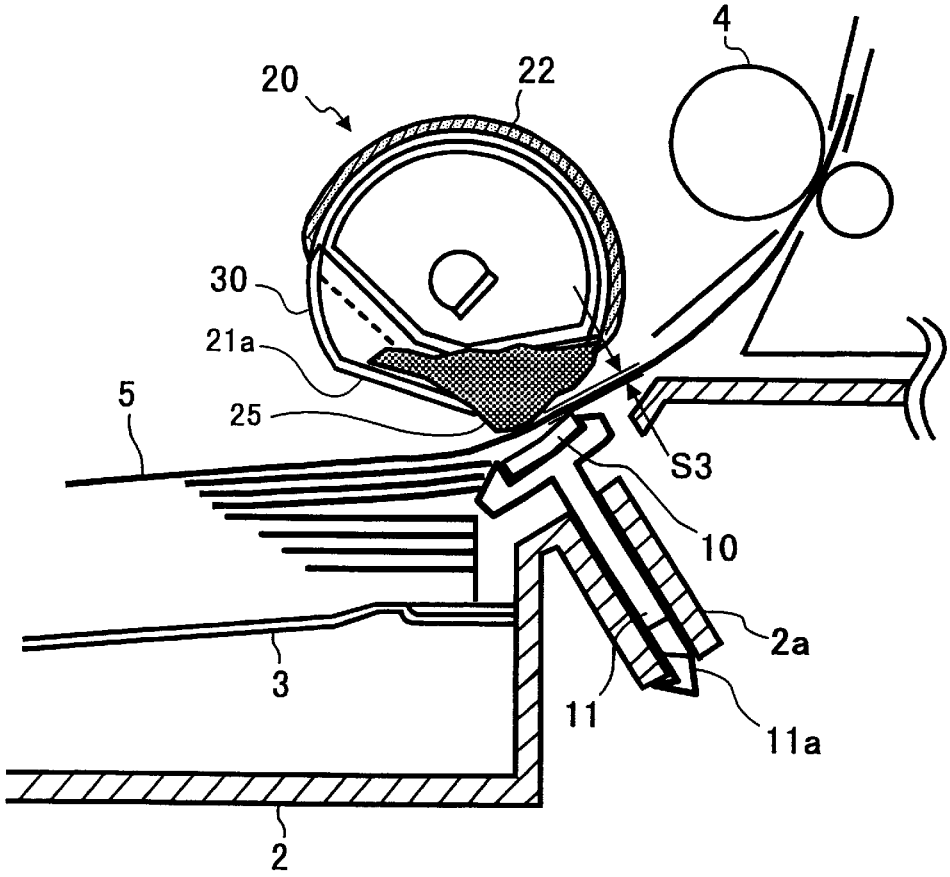
FIG. 1A is a cross-sectional view illustrating a main part of a sheet feeding device according to a first embodiment of the present invention.

Referring now to the drawings, wherein like reference characters designate identical or corresponding parts throughout the several views, the preferred embodiments of the present invention will now be described. For the sake of clarity, elements having substantially the same functions as the ones in the conventional sheet feeding device described above, will be designated with the same reference characters and a description thereof will be omitted.

Figure 1B:
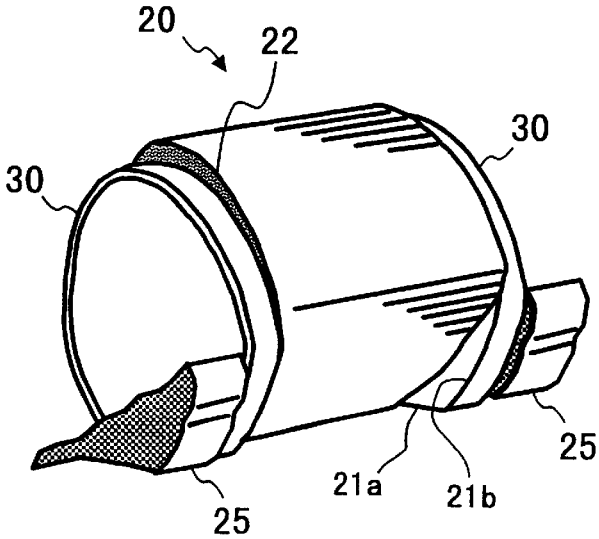
FIG. 1B is a perspective view of a sheet feeding roller and a gap regulating member according to the first embodiment of the present invention.
Figure 8A:
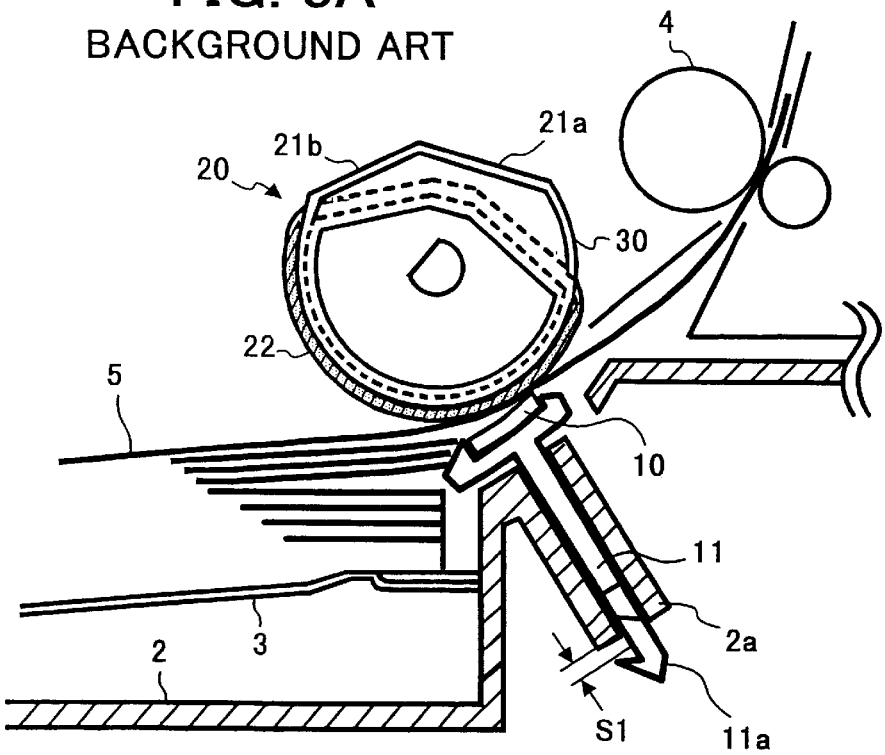
FIG. 8A BACKGROUND ART
FIG. 8A is a cross-sectional view illustrating a conventional sheet feeding device when a sheet feeding roller, having a cross-sectional shape of a partly cut-off circle, feeds a sheet.
Figure 8B:
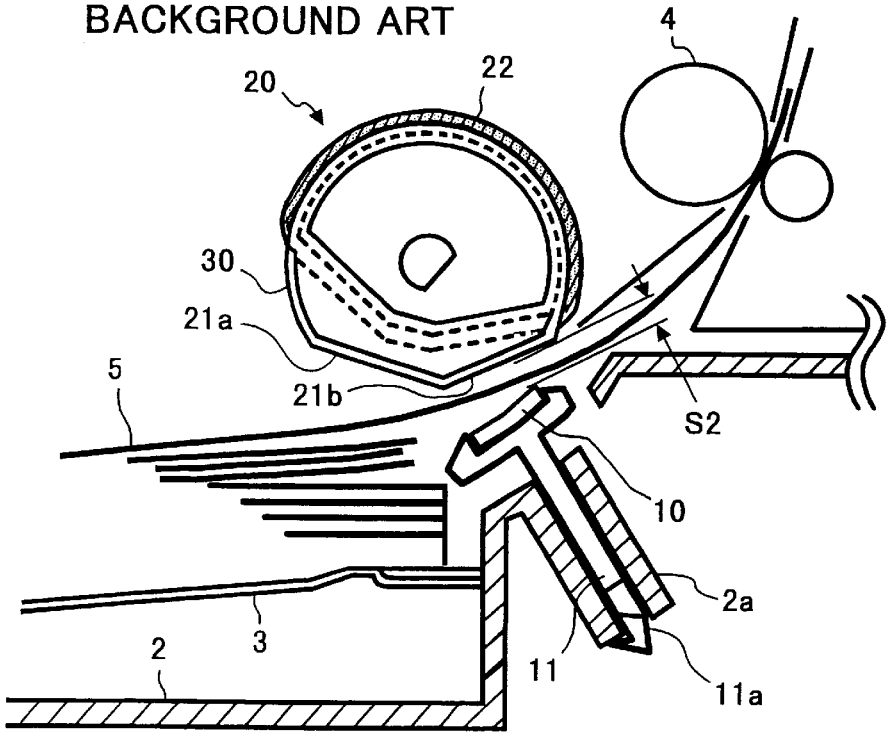
FIG. 8B BACKGROUND ART
FIG. 8B is a cross-sectional view illustrating the conventional sheet feeding device when the sheet feeding roller of FIG. 8A is in a standby condition.
Figure 9:
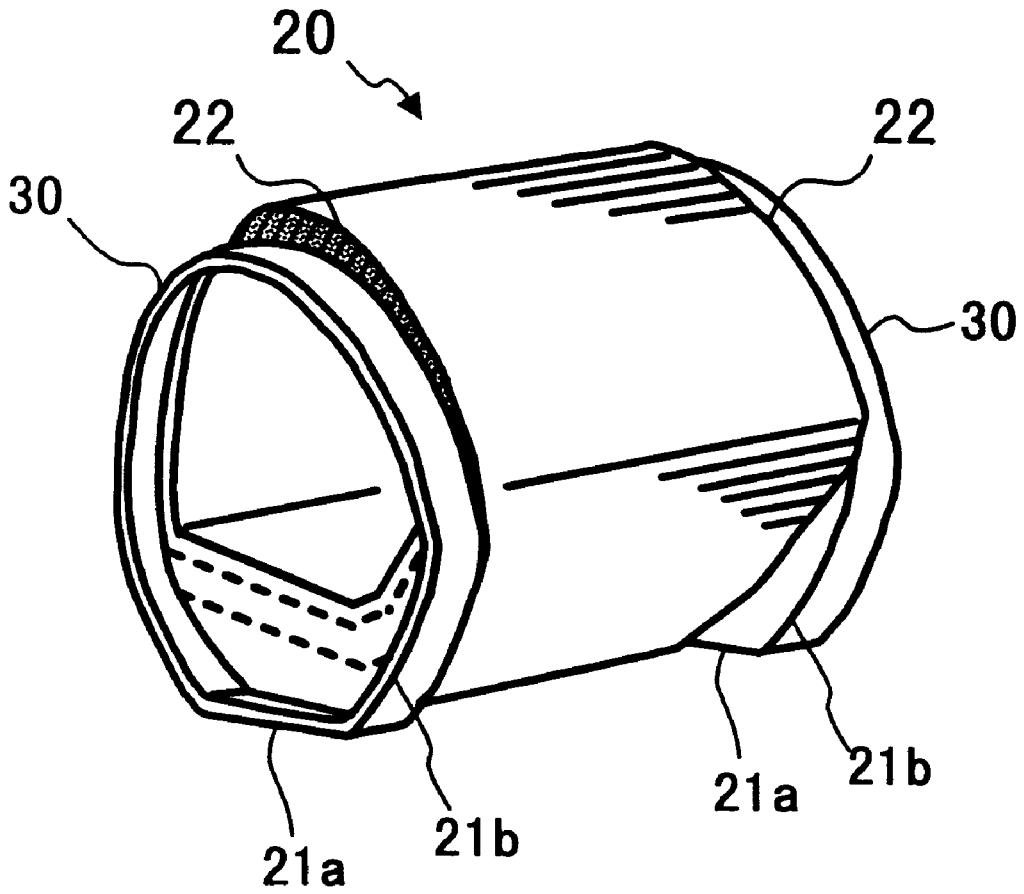
FIG. 9 BACKGROUND ART
FIG. 9 is a perspective view of the sheet feeding roller of FIGS. 8A and 8B.

Referring to FIGS. 1A and 1B, the first embodiment includes two gap regulating member 25. The two gap regulating members 25 are separately provided to the side-lower portion of respective flange portions 30 so as to face the friction pad 10 and to regulate the gap S2 between the chord portion 21*b* of the sheet feeding roller 20 and the upper surface of the friction pad 10 (function of hook-shaped pawl (11A) is described in FIGS. 8A and 8B). As illustrated in FIG. 1A, the gap regulating member 25 narrows the gap S2 by the portion protruding downwardly of the gap regulating member 25. portion of respective flange portions 30 so as to face the friction pad 10 and to regulate the gap S3 between the chord portion 21*b* of the sheet feeding roller 20 and the upper surface of the friction pad 10 (function of hook shaped pawl (11A) is described in FIGS. 8A and 8B). As illustrated in FIG. 1A, the gap regulating member 25 narrows the gap S3 by the portion protruding downwardly of the gap regulating member 25.

A gap S3 between the protruding lower-most portion of the gap regulating member 25 and the upper surface of the friction pad 10 is set to, for example, 0.8 mm so as to limit the number of the sheets 5 which can enter the gap S3. As a result, it can avoid causing a plurality of sheets 5 under a top sheet from being conveyed together with the top sheet (i.e., double feeding of the sheets 5) when the top sheet is conveyed by the sheet conveying rollers 4. In this embodiment, when the sheet feeding roller 20 is in the standby condition: (1) the load received by the sheets 5 can be reduced by keeping the chord portion 21*b* of the sheet feeding roller 20 apart from the friction pad 10 and the stack of the sheets 5 in the sheet feeding cassette 2; and (2) the double feeding of the sheets 5 can be prevented, when the top sheet is conveyed by the sheet conveying rollers 4, by providing the gap regulating members 25 to the sheet feeding roller 20.

When the gap regulating member 25 is formed of resin, such as, for example, polyacetal resin, the top sheet of the sheets 5 slidably contacts the gap regulating member 25 when the top sheet of the sheets 5 is conveyed by the sheet conveying rollers 4, so that friction between the top sheet of the sheets 5 and the surface of the gap regulating member 25 is small. As a result, when the sheet feeding roller 20 is in the standby condition, the load received by the top sheet of the sheets 5 can be reduced when the top sheet of the sheets 5 is conveyed by the sheet conveying rollers 4.

Figure 2A:
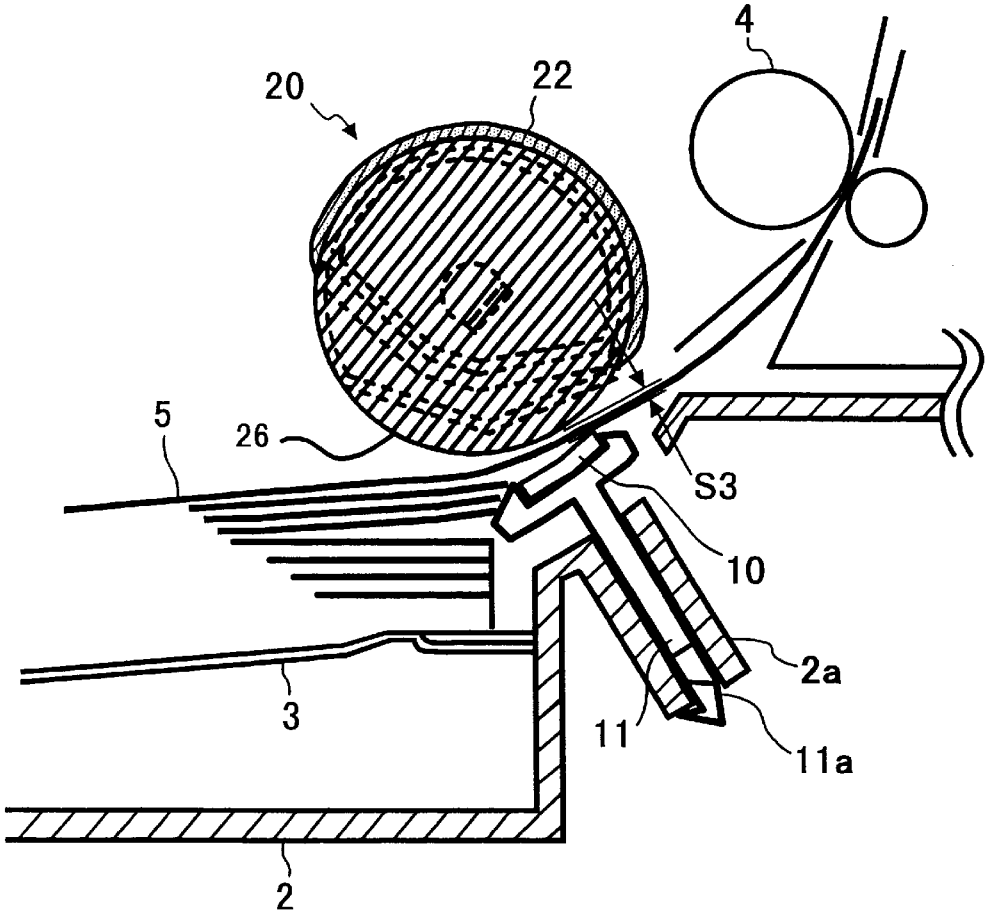
FIG. 2A is a cross-sectional view illustrating a main part of a sheet feeding device according to a second embodiment of the present invention.
Figure 2B:
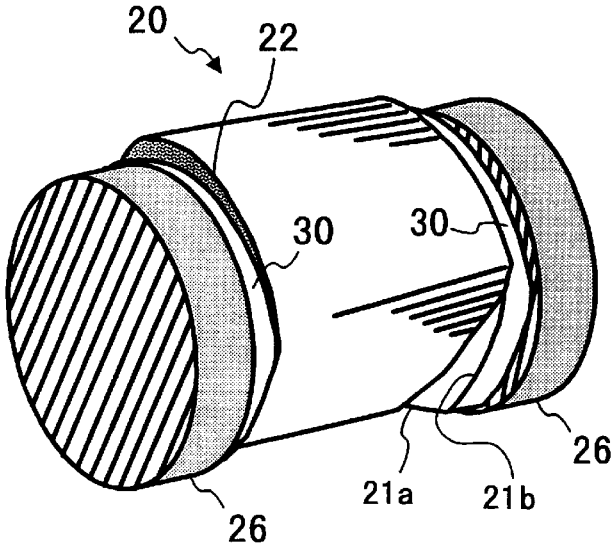
FIG. 2B is a perspective view of a sheet feeding roller and a gap regulating member according to the second embodiment of the present invention.

Referring to FIGS. 2A and 2B, a second embodiment of the present invention illustrates two gap regulating members 26. The two gap regulating members 26 are formed in a cylindrical shape and are separately provided at each side of the flange portions 30 so as to face the friction pad 10 and to regulate the gap S2 between the chord portion 21*b* of the sheet feeding roller 20 and the upper surface of the friction pad 10. The gap regulating members 26 rotate about the same axis and in the same direction as the sheet feeding roller 20. A gap S3 between the lower-most arcs of the gap regulating members 26 and the upper surface of the friction pad 10 can be narrower than the gap S2 described in FIG. 8B. Therefore, like the sheet feeding device in the first embodiment, the number of the sheets 5 which can enter the gap S3 can be limited, so that double feeding of the sheets 5 can be avoided.

Figure 3:
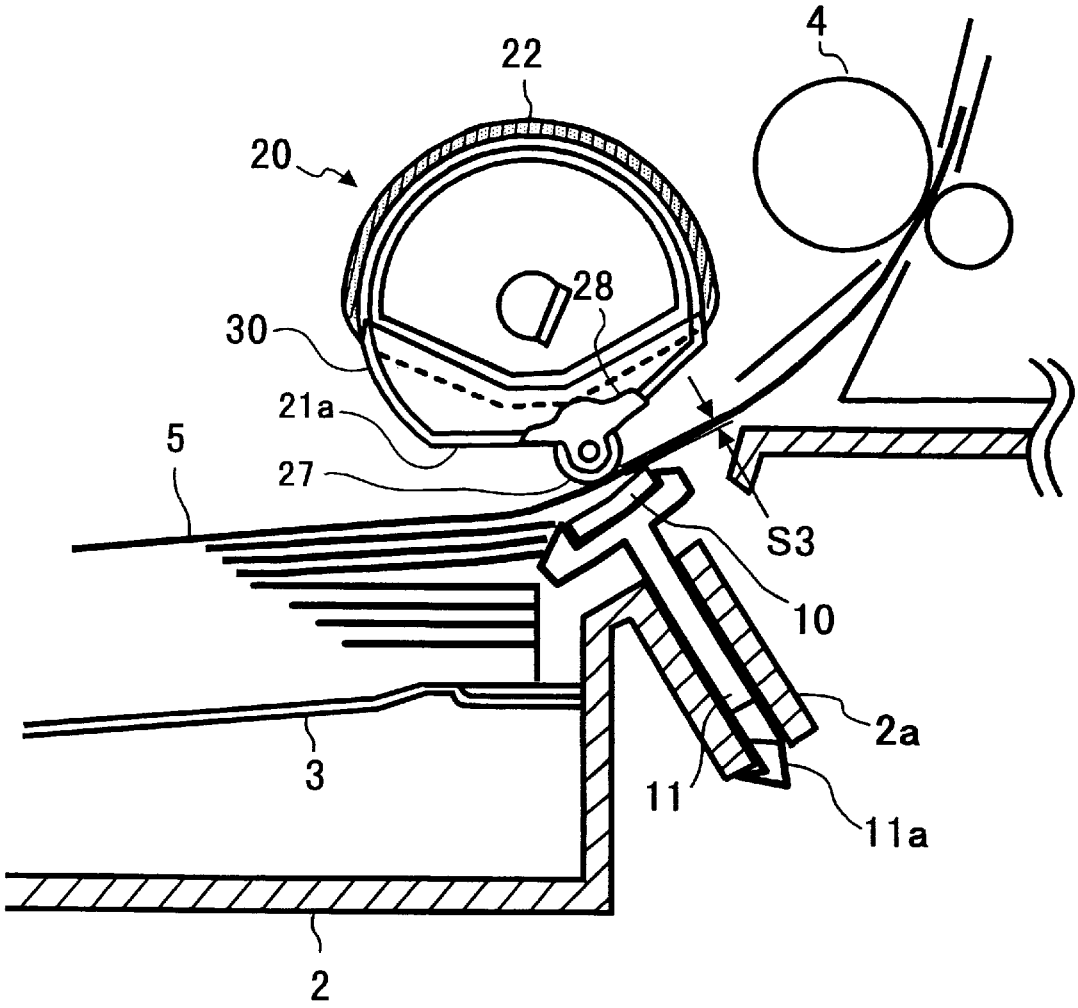
FIG. 3 is a cross-sectional view illustrating a main part of a sheet feeding device according to a third embodiment of the present invention.

Referring to FIG. 3, a third embodiment of the present invention is shown. In the third preferred embodiment, two gap regulating members 27 in a miniature cylindrical shape are separately provided on the side-lower portion of respective flange portions 30 and above the friction pad 10 such that the gap regulating members 27 can rotate in the same direction as the sheet feeding roller 20. Attaching members 28 are provided to the sheet feeding device so as to attach respective gap regulating members 27 to the sheet feeding device, and a part thereof is illustrated in FIG. 3. The attaching members 28 can be also used to attach the sheet feeding roller 20 and the friction pad pedestal 11 to the sheet feeding device. A gap S3 between the lower-most arc of the gap regulating member 27 and the upper surface of the friction pad 10 can be narrower than the gap S2 described in FIG. 8B. Therefore, like the sheet feeding devices in the first and second embodiments, the number of sheets 5 which can enter the gap S3 can be limited, so that double feeding of the sheets 5 can be avoided.

In both second and third embodiments, as the gap regulating members 26 and 27 are cylindrical in shape and rotatable in the same direction as the sheet feeding roller 20, the load received by the top sheet of the sheets 5, when the top sheet of the sheets 5 is conveyed by the sheet conveying rollers 4 and contacts the gap regulating members 26 and 27, can be reduced.

Figure 4A:
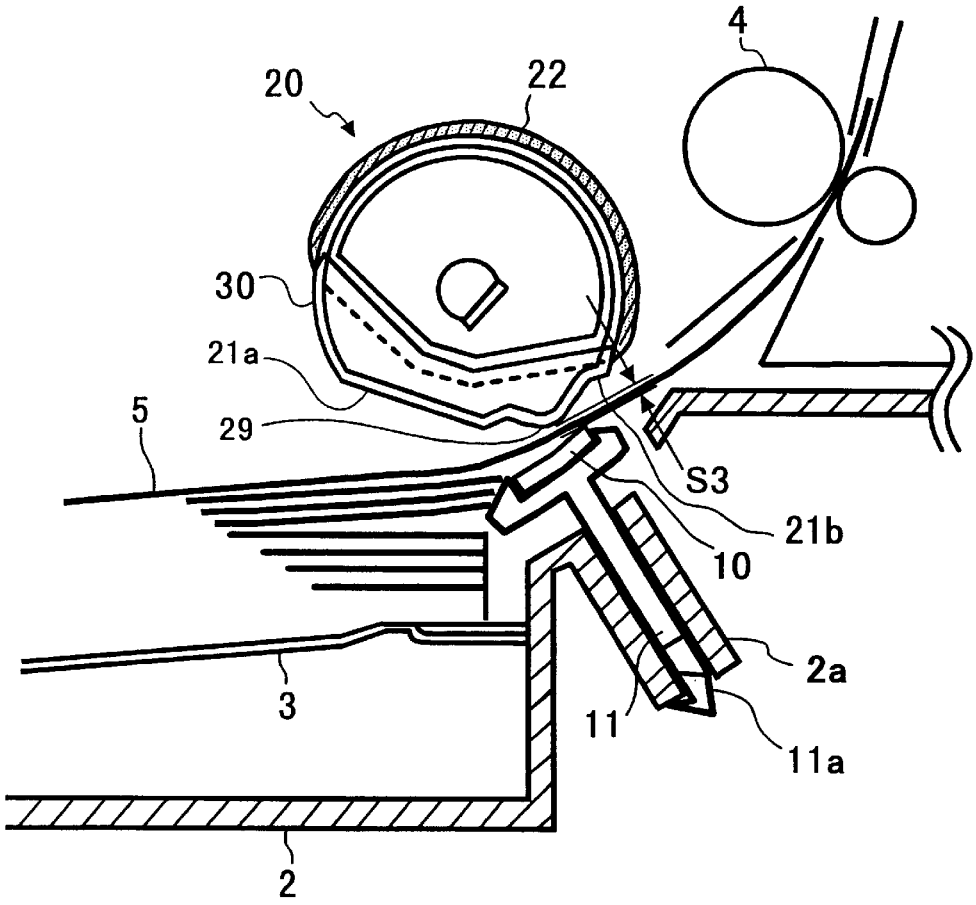
FIG. 4A is a cross-sectional view illustrating a main part of a sheet feeding device according to a fourth embodiment of the present invention.
Figure 4B:
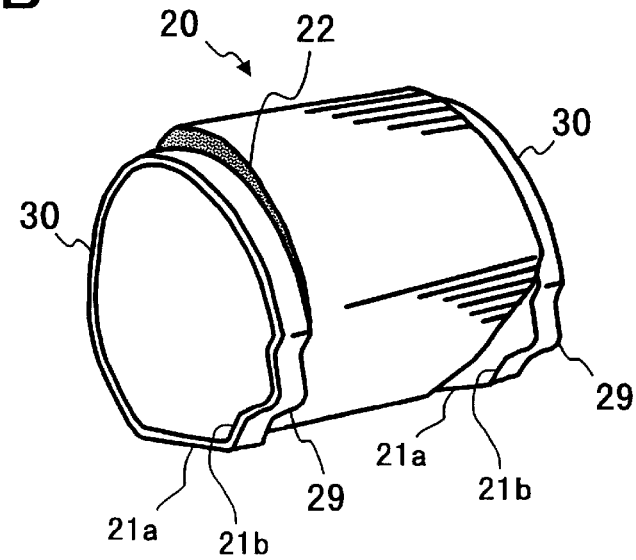
FIG. 4B is a perspective view of a sheet feeding roller including a gap regulating portion according to the fourth embodiment of the present invention.
Figure 5:
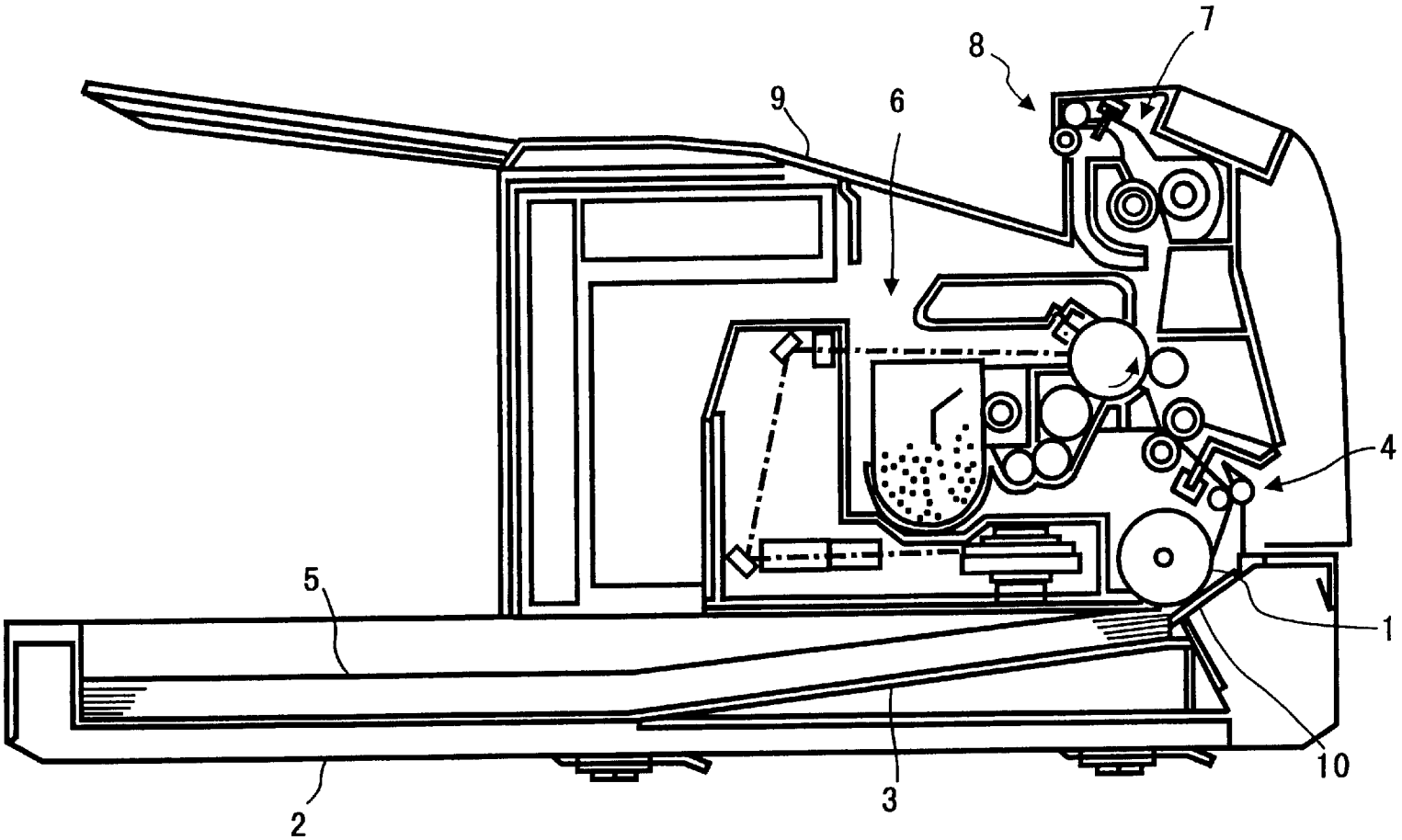
FIG. 5 BACKGROUND ART
FIG. 5 is a schematic cross-sectional view illustrating a conventional sheet feeding device of an image forming apparatus, such as a laser printer.
Figure 6:
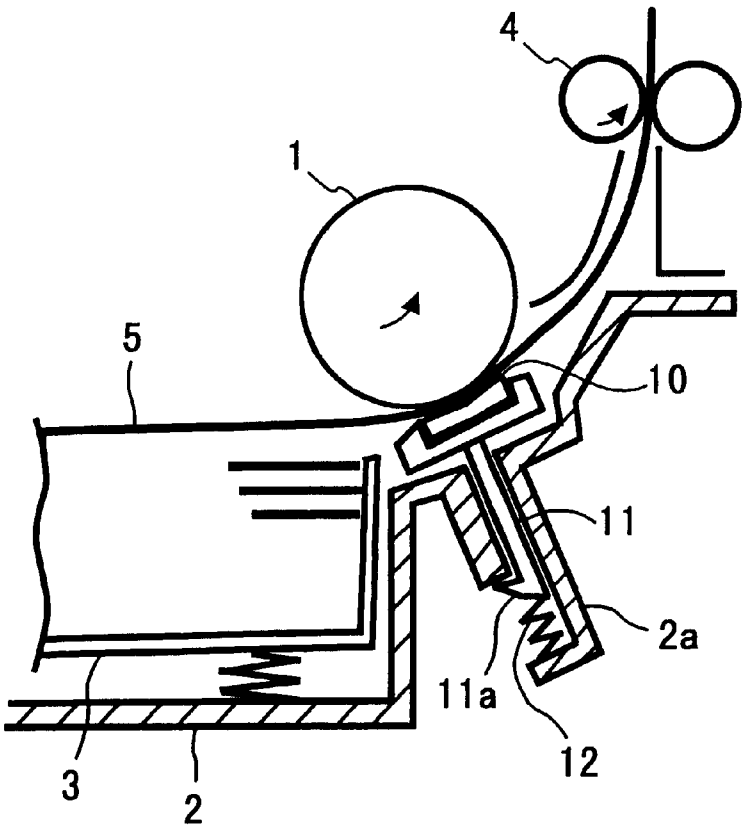
FIG. 6 BACKGROUND ART
FIG. 6 is a cross-sectional view illustrating a part in the vicinity of a sheet feeding roller of the conventional sheet feeding device of FIG. 5.
Figure 7A:
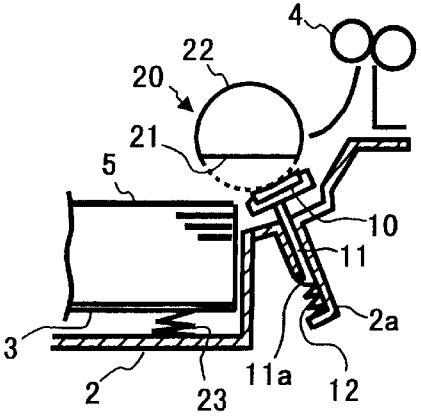
FIG. 7A BACKGROUND ART
FIGS. 7A through 7D are cross-sectional views illustrating a conventional sheet feeding device employing a sheet feeding roller having a cross-sectional shaped of a partly cut-off circle.
Figure 7B:
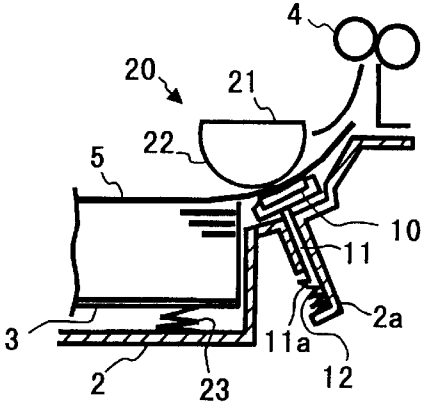
FIG. 7B BACKGROUND ART
Figure 7C:
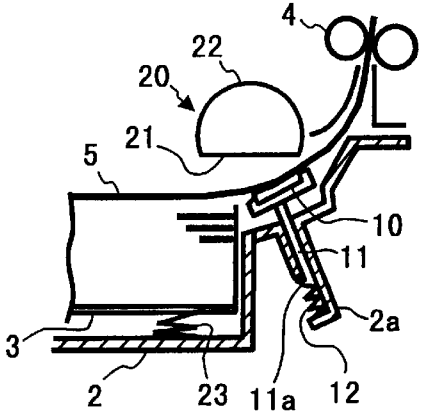
FIG. 7C BACKGROUND ART
Figure 7D:
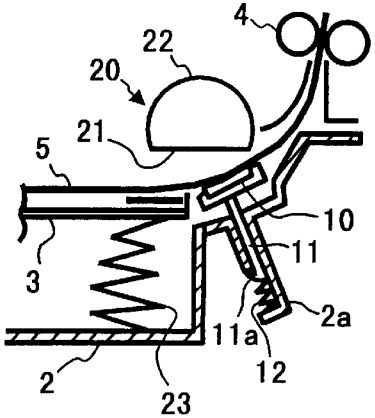
FIG. 7D BACKGROUND ART

Referring to FIGS. 4A and 4B, a fourth embodiment of the present invention is shown. In the fourth embodiment, the chord portion 21*b* of the sheet feeding roller 20 includes a gap regulating portion 29 that is formed as an integral part of the chord portion 21*b* so as to face the friction pad 10 and to regulate the gap S2 described in FIG. 8B. Because the gap regulating portion 29 protrudes from the chord portion 21*b* toward the friction pad 10, a gap S3 between the lower-most surface of the gap regulating portion 29 and the upper surface of the friction pad 10 can be narrower than the gap S2 in FIG. 8B. Therefore, the number of sheets 5 which can enter the gap S3 can be limited, so that double feeding of the sheets 5 can be avoided when the top sheet of the sheets 5 is conveyed by the sheet conveying rollers 4.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A sheet feeding device, comprising:

a sheet feeding cassette configured to accommodate a stack of sheets;

a sheet feeding roller that is provided downstream of said sheet feeding cassette in a sheet conveying direction to feed a top sheet of the stack of sheets in said sheet feeding cassette, said sheet feeding roller having a cross-sectional shape of a partly cut-off circle including an arc portion and at least one chord portion;

a friction pad that is provided opposite said sheet feeding roller to separate the top sheet from the stack of sheets in said sheet feeding cassette; and a regulating member that is provided for said sheet feeding roller so as to face said friction pad and to regulate a gap between said chord portion of said sheet feeding roller and an upper surface of said friction pad, wherein, when said sheet feeding roller is in a standby condition, said sheet feeding roller is held such that said chord portion of said sheet feeding roller faces said friction pad and the stack of sheets in said sheet feeding cassette a predetermined distance apart therefrom, said friction pad is held at a more elevated position than when said friction pad abuts said arc portion of said sheet feeding roller, and a periphery of said regulating member is closer to said upper surface of said friction pad than said chord portion of said sheet feeding roller.

2. The sheet feeding device according to claim 1, wherein the top sheet slidably contacts said regulating member when the top sheet is conveyed.

3. The sheet feeding device according to claim 2, wherein said regulating member includes resin.

4. The sheet feeding device according to claim 1, wherein said regulating member rotates in a same direction as said sheet feeding roller.

5. A sheet feeding device, comprising:

means for accommodating a stack of sheets;

means for feeding a top sheet of the stack of sheets in said accommodating means, said feeding means being provided downstream of said accommodating means in a sheet conveying direction and having a cross-sectional shape of a partly cut-off circle including an arc portion and at least one chord portion;

means for separating the top sheet from the stack of sheets in said accommodating means, said separating means being provided opposite said feeding means; and means for facing said separating means and regulating a gap between said chord portion of said feeding means and an upper surface of said separating means, said facing and regulating means being provided to said feeding means, wherein, when said feeding means is in a standby condition, said feeding means is held such that said chord portion of said feeding means faces said separating means and the stack of sheets in said accommodating means a predetermined distance apart therefrom, said separating means is held at a more elevated position than when said separating means abuts said arc portion of said feeding means, and a periphery of said facing and regulating means is closer to said upper surface of said separating means than said chord portion of said feeding means.

6. The sheet feeding device according to claim 5, wherein the top sheet slidably contacts said facing and regulating means when the top sheet is conveyed.

7. The sheet feeding device according to claim 6, wherein said facing and regulating means includes resin.

8. The sheet feeding device according to claim 5, wherein said facing and regulating means rotates in a same direction as said feeding means.

9. An image forming apparatus having an image forming section and a fixing section fixing an image on a recording member, comprising:

a sheet feeding device including:

a sheet feeding cassette configured to accommodate a stack of sheets;

a sheet feeding roller that is provided downstream of said sheet feeding cassette in a sheet conveying direction to feed a top sheet of the stack of sheets in said sheet feeding cassette, said sheet feeding roller having a cross-sectional shape of a partly cut-off circle including an arc portion and at least one chord portion;

a friction pad that is provided opposite said sheet feeding roller to separate the top sheet from the stack of sheets in said sheet feeding cassette; and a regulating member that is provided to said sheet feeding roller so as to face said friction pad and to regulate a gap between said chord portion of said sheet feeding roller and an upper surface of said friction pad, wherein, when said sheet feeding roller is in a standby condition, said sheet feeding roller is held such that said chord portion of said sheet feeding roller faces said friction pad and said stack of sheets in said sheet feeding cassette a predetermined distance apart therefrom, said friction pad is held at a more elevated position than when said friction pad abuts said arc portion of said sheet feeding roller, and a periphery of said regulating member is closer to said upper surface of said friction pad than said chord portion of said sheet feeding roller.

10. The image forming apparatus according to claim 9, wherein the top sheet slidably contacts said regulating member when the top sheet is conveyed.

11. The image forming apparatus according to claim 10, wherein said regulating member includes resin.

12. The image forming apparatus according to claim 9, wherein said regulating member rotates in a same direction as said sheet feeding roller.

* * * * *

UNITED STATES PATENT AND TRADEMARK OFFICE

CERTIFICATE OF CORRECTION

PATENT NO. : 6,341,774 B1
DATED : January 29, 2002
INVENTOR(S) : Ueda

It is certified that error appears in the above-identified patent and that said Letters Patent is hereby corrected as shown below:

Title page, Item [54], and Column 1, lines 1-5,
Title should read -- [54] SHEET FEEDING DEVICE HAVING GAP REGULATING MEMBER TO AVOID DOUBLE FEEDING OF SHEETS AND IMAGE FORMING APPARATUS USING SHEET FEEDING DEVICE --

Signed and Sealed this

Twenty-third Day of April, 2002

*Attest:*

*Attesting Officer*

JAMES E. ROGAN
*Director of the United States Patent and Trademark Office*